United States Patent [19]

Bradt

[11] 4,421,421

[45] Dec. 20, 1983

[54] KINETIC CLOCK SCULPTURE

[76] Inventor: Gordon E. Bradt, Kinetico Center, Busch, Ark. 72620

[21] Appl. No.: 351,414

[22] Filed: Feb. 23, 1982

[51] Int. Cl.[3] ..... G04B 19/06

[52] U.S. Cl. ..... 368/229; 368/15; 368/179; 368/272; 368/285

[58] Field of Search ..... 368/272, 179, 180, 285, 368/229, 15–18, 23; D10/6–8, 33–35

[56] References Cited

U.S. PATENT DOCUMENTS

| | | | |
|---|---|---|---|
| 337,377 | 3/1886 | Chase | 368/229 |
| 344,922 | 7/1886 | Rebentisch | 368/229 |
| 401,499 | 4/1889 | Junghans | 368/229 |
| 431,282 | 7/1890 | Phelps | 368/229 |
| 2,185,805 | 1/1940 | Feiner | 368/179 |
| 2,574,048 | 11/1951 | Marmor | 368/229 |

FOREIGN PATENT DOCUMENTS

| | | | |
|---|---|---|---|
| 837079 | 4/1952 | Fed. Rep. of Germany | 368/229 |
| 500649 | 11/1954 | Italy | 368/229 |
| 550361 | 6/1943 | United Kingdom | 368/229 |

*Primary Examiner*—Ulysses Weldon

*Attorney, Agent, or Firm*—McWilliams, Mann, Zummer, and Sweeney

[57] ABSTRACT

A time keeping clock that includes a kinetic clock sculpture arrangement in which the clock comprises the usual minute and hour hands journalled for rotation in clockwise directions about a common axis, and a time keeping mechanism for driving said minute and hour hands to keep time, with the clock including a kinetic sculpture arrangement comprising a relatively large, medially located, kinetic sculpture drive gear wheel that is vertically disposed and has its axis of rotation disposed horizontally and paralleling that of the common axis of the clock minute and hour hands, one or more driven gear wheels that are of a diameter which is relatively small as compared to that of the drive wheel gear, and which are disposed in coupled rotation to the drive gear wheel at spaced locations thereabout, with several of said driven gear wheels each driving a separate crank about a horizontal axis, and a drive gear wheel actuated mechanical linkage of miniature stick figure form articulated to each of the said cranks, with each of the said linkages being disposed in upright relation adjacent to and at the level of the crank to which same is articulated, with the stick figure linkages being contoured, anchored, and articulated in place for simulating front to back human like motion involving a rotation of the cranks, suggestive that they are assisting in driving the time keeping mechanism, with the kinetic sculpture also including drive gear wheel actuated cam arm and rocking beam arrangements to which similar stick figure linkages located at various positions about the clock are articulated for the same purpose.

21 Claims, 3 Drawing Figures

KINETIC CLOCK SCULPTURE

FIELD OF THE INVENTION

This invention concerns a clock design which incorporates kinetic sculpture mechanisms.

BACKGROUND OF THE INVENTION

Over the centuries, clock designs have on occasion been embellished with kinetic actions to add interest that were not involved with the function of timekeeping. Also, functional actions such as pendulums, balances and escapements were often featured for interest. Pendulums took such forms as cupids on a swing or Villard's flying ball clock pendulum (invented c. 1240). Also very interesting kinetic motion type mechanisms were the rolling ball balance-escapement clocks invented by the Frenchman Grollier in the seventeenth century and further developed by Congreve, the Englishman.

Then, of course, the entire timekeeping mechanisms were often displayed in versions called skeleton clocks.

Timekeeping functions of the periodic nature such as chime striking were sometimes featured in kinetic motions such as a mechanical man swinging a mallet to strike the chimes. These actions were still of a timekeeping nature as they acted each quarter hour, or half hour or hour. The classic of this chime striking action is of course the cuckoo.

Clock mechanisms have traditionally been powered by gravity, wound springs and electric motors. These power mechanisms were kept separate between the continuous timekeeping functions and the periodic functions. This is mainly because the continuous timekeeping movements were very slow, ranging from the second hand at 1 RPM, minute hand at 1/60 RPM, and the hour hand at 1/720 RPM.

The striking functions, however, are periodic, not continuous and run about 20 to 60 RPM. So, separate power sources are employed. As an example, cuckoo clocks use one weight or key wound spring for the continuous mechanism that involves the hour hand, the minute hand, and the pendulum; then they make use of a separate weight or key wound spring for the periodic cuckoo mechanism and the bellows for the cuckoo call.

SUMMARY OF THE INVENTION

One of the objects of the present invention is to provide a clock design which incorporates a clock mechanism with a kinetic sculpture action mechanism that:

a. incorporates miniature figures, such as mechanical men, that are acting in such ways as to appear to be making the clock run;
b. utilizes a variety of mechanical actions such as cams, cranks, levers, rocking beams, lift arms and meshing gears, to provide optimum action and interest;
c. provides a unique mechanism which allows a single motor or other single power means to run both the continuous timekeeping mechanism and the kinetic sculpture mechanism.
d. provides a mechanism that centrally activates a variety of dispersed linkages; and
e. provides a low cost and reliable mechanism that imparts a variety of action movements.

The foregoing and other objects and features of this invention will be more fully understood from the following description of the illustrated embodiment thereof taken in conjunction with the accompanying drawings.

DESCRIPTION OF THE ILLUSTRATED EMBODIMENT

Figure 1:
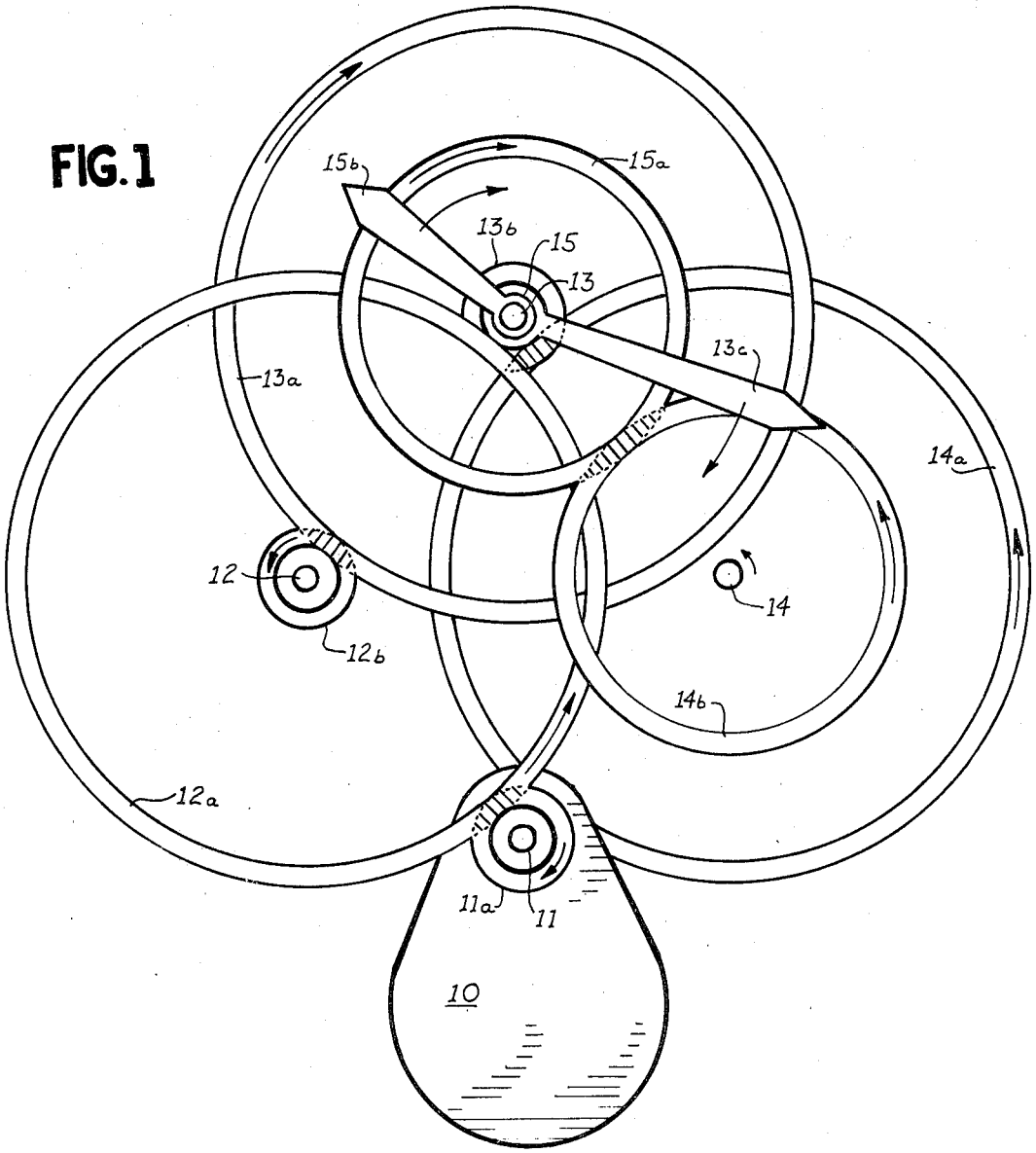
FIG. 1 is a diagramatic view of a clock gear train as used in the present invention, with the minute and hour hands being journalled for rotation about the usual common axis that is horizontally disposed and extends normally of the action of gravity.

Referring to FIG. 1, the continuous timekeeping mechanism of the present invention is diagrammatically shown. A synchronous motor 10 is shown, which has a shaft output of 4 RPM clockwise. A pinion gear or driving gear wheel 11*a* on the motor shaft 11 drives a spur gear or driven gear wheel 12*a*. This provides a sixteen to one gear reduction thus driving shaft 12 at $\frac{1}{4}$ RPM. A pinion gear or driving gear wheel 12*b* on shaft 12 in turn drives spur gear or driven gear wheel 13*a* to give a fifteen to one gear reduction. This gives shaft 13 a 1/60 RPM which is the proper speed to drive the clock's minute hand 13*c* which is frictionally mounted to shaft 13.

A pinion gear or driving gear wheel 13*b* on shaft 13, in turn, drives a spur gear or driven wheel 14*a* to give a twelve to one reduction. This drives shaft 14 at 1/720 RPM which is the proper speed for the hour hand, but is in the incorrect, counter clockwise, rotation and is not centered with the minute hand. To correct this, a spur gear or driving gear wheel 14*b* on shaft 14 is mated with a spur gear or driven gear wheel 15*a* of the same number of teeth, on a tubular shaft 15, which is concentric with shaft 13. This drives the tubular shaft 15 at 1/720 RPM clockwise. The hour hand 15*b* is frictionally mounted to tubular shaft 15.

Figure 2:
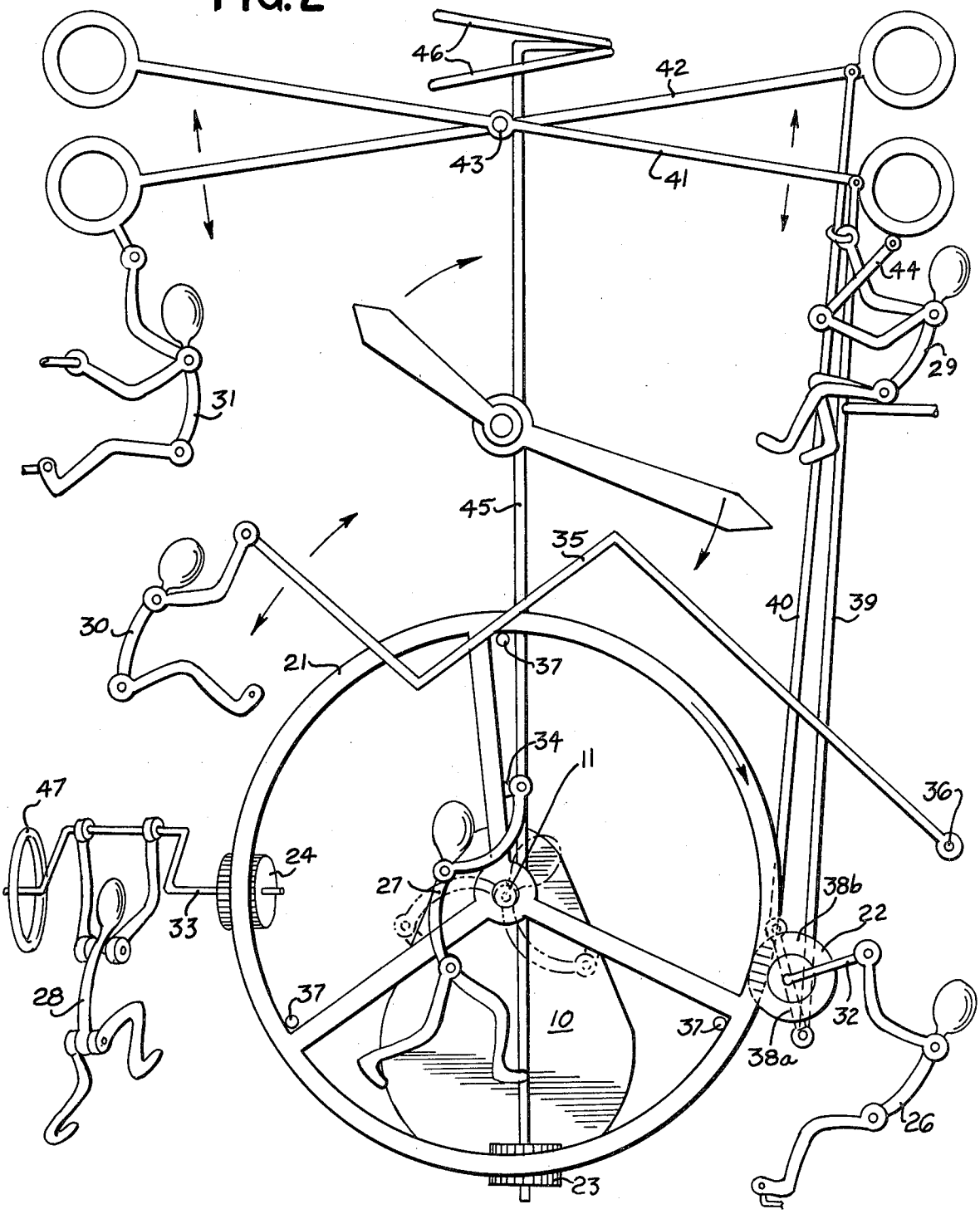
FIG. 2 is a diagramatic view of the kinetic action mechanisms in the present invention.

Referring to FIG. 2, the kinetic sculpture function of the present invention is shown in one embodiment of the invention. The 4 RPM motor 10 also directly drives a large gear or driving gear wheel 21 about its own axis that coincides with that of shaft 11. This gear wheel 21 has teeth on its edge that also curve around to the back face as well. This allows gear or driven gear wheel 22 to be driven with its shaft parallel to the gear 21 shaft 11, and at the same time it allows gear or driven gear wheel 23 to be driven with a shaft 45 essentially perpendicular to gear 21 shaft 11, and allows another gear or driven gear wheel 24 to be driven with its shaft skewed in relation to the shaft of drive gear 21.

Six mechanical figures in the form of mechanical men 26, 27, 28, 29, 30 and 31 are activated by various mechanisms driven by the motor 10. These mechanical men are essentially stick figures that can pivot front to back at their feet, hips, shoulders and hands, the pivot shafts or pins involved running side to side, with the said pivot shafts of the respective mechanical men thus being essentially parallel. The knees, elbows and necks of the men are fixed in a realistic bent position. The legs do not move in relation to each other. That is, the legs of the respective men are either disposed in parallel and pivot at their feet from a common pivot shaft or pin, or such legs are spread with the feet secured or anchored against movement, thus establishing the hip pivot shaft or pin in a fixed or stationary pivot providing position.

Unless the men are hanging or suspended in their support, from the articulating linkage that supports same, by at least one hand, they pivot only at three places, that is, at three of their pivot shafts, to keep them from collapsing or jack-knifing.

Thus, men 27 and 28 are fixed or stationary at their feet, with their feet disposed in a spread apart, front to rear, position, thus placing their hip pivots in a fixed or stationary pivot providing location. Their respective shoulder pivots are in a moving location as well as their respective hand pivots.

Man 26 does not pivot at his shoulders so that he can pivot at his feet in a fixed location and pivot at his hips and hands in moving locations.

Man 29, in a fixed sitting position, has his hip pivot at a fixed pivot providing location, and his shoulders and hands at moving pivot locations.

Men 30 and 31 are in the hanging relation mentioned above and thus can pivot at more than three points. They both have their feet at a fixed or stationary pivot location. Their hip and shoulder pivots are in moving locations. Man 30 has both hands pivoted on one moving point. Man 31 has one hand pivoted from a moving point connected to rocking beam 42 and the other hand pivoting from a fixed or stationary point.

Another requirement for a practical and human-like motion is that if the men are not hanging, their two outside pivot points must not move far enough apart that they allow the shoulders or the hips to jack-knife forward.

With the hanging men, their hand pivot is kept in back of their feet pivot and these pivots are kept close enough together to keep the men hanging in natural positions.

Now, as to the methods for activating the mechanical men: Gear 22 drives a crank 32 to which the hands of man 26 are pivotally attached and driven in a circular rotation. Likewise, gear 24 drives crank 33 to which the hands of man 28 are pivotally attached. As shown in FIG. 2, the throw leverages of cranks 32 and 33 are each a fraction of the radius of the large drive gear wheel 21, but exceed the radius and diameter of the driven gear wheels 22 and 24, respectively.

Man 27 has his hands pivotally attached to a, pivot pin 34 on a spoke of drive gear wheel 21 and his hands are thus driven in a circular rotation about the axis of drive gear wheel 21.

Man 30 is activated by a cam arm or bar 35 which pivots at point 36. Arm or bar 35 rides sequentially on cam pins or studs 37 located on drive gear 21. These cam pins or studs 37 are parallel to the drive gear 21 shaft. The hands of man 30 are pivotally mounted to the end of cam arm 35 and the man 30 swings up and down as the arm 35 rises and falls as it sequentially is lifted and dropped by pins 37. Cam arm or bar 35 and cam pins 37 are thus in coplanar relation, and it will be noted that cam arm or bar 35 is of zig-zag configuration in the plane of the cam arm or bar 35 and cam pins or studs 37.

Opposing crank shafts 38*a* and 38*b* are axially connected to gear 22 and crank 32, to which lift arms 39 and 40 are pivotally connected. These arms 39 and 40 are in turn pivotally connected, as indicated in FIG. 2, to rocking beams 41 and 42 which pivot on, shaft 43. These beams rock in opposite, converging and diverging fashion, as gear 22 and crank 32 are rotated about their common axis.

Optionally, a third fixed beam may be mounted to shaft 43 between the moving beams. This enhances the optical allusion of a fan opening and closing.

Man 29 is activated by these rocking beams 41 and 42 by one hand being directly pivotally attached to lift arm 40 and the other hand by means of a short link 44 pivotally to rocking beam 41, as indicated in FIG. 2. The link 44 is needed because the arms and body of man 29 swing through a slightly conflicting path from the compound path of the lift arms and rocking beams.

Man 31 has one hand pivotally connected to rocking beam 42 while the other hand is pivotally connected to a fixed or stationary position on the clock frame. The feet of man 31 are also pivotally connected to a fixed or stationary position on the clock frame below that of the hand. Thus his hips and shoulders swing about the fixed or stationary pivot of the feet and one hand respectively, while the other hand activates the degree of swing as dictated by the movement of the rocking beam 42 from which man 31 hangs in being supported by beam 42.

Further kinetic action in the invention is accomplished by gear 23 driving vertical shaft 45. A pair of rings 46 are attached to the top of shaft 45 in a skewed configuration to give a converging-diverging kinetic illusion as they rotate. Further kinetic motion is accomplished by mounting a flywheel 47 on the end of crank shaft 33.

Figure 3:
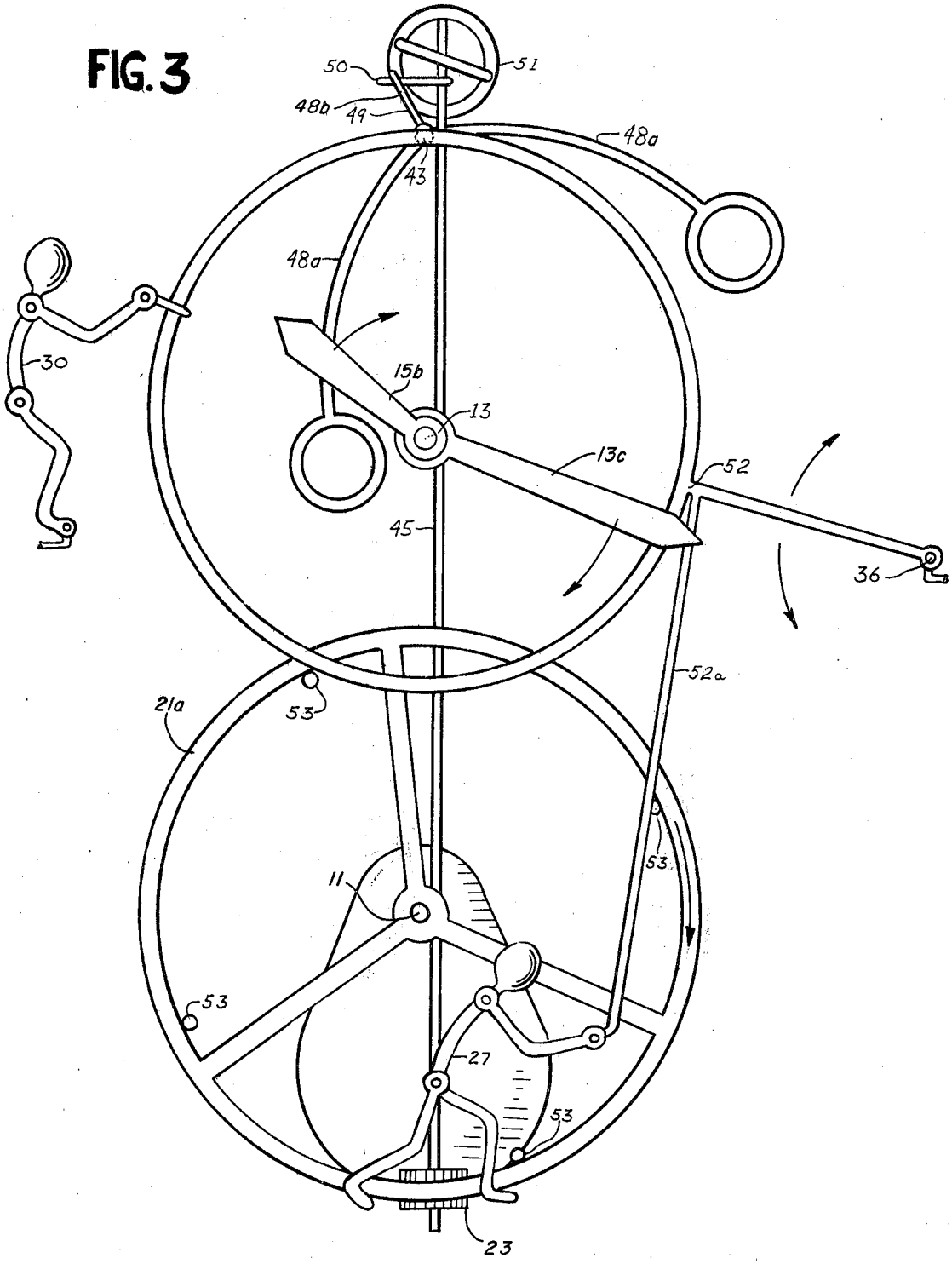
FIG. 3 is a diagramatic view of alternate kinetic mechanisms.

Referring to FIG. 3, options to the FIG. 2 embodiment are shown in which a free swinging bifurcated pendulum 48 swings from the aforementioned pivot shaft 43 instead of, or in addition to the rocking beams 41 and 42 of FIG. 2. This pendulum 48 is in a wishbone shape to straddle the minute hand shaft 13. The pendulum 48 swings in a plane perpendicular to minute hand shaft 13 and is separated from or to one side of the vertical shaft 45 axially of shaft 13. An ear or kick pin or stud 49 is attached to the top of pendulum 48 adjacent the junction of its arms 48*a* and forms the wishbone common base arm 48*b* that defines kick pin 49. Also a cam pin or stud 50 is attached to the shaft 45. The cam pin 50 is long enough to reach and push the kick pin 49 as the cam pin 50 rotates. This sets the pendulum 48 to swinging and maintains the swinging action each time cam pin 50 revolves on shaft 45.

Also on top of shaft 45 is a pair of intersecting rings 51 in the shape of a globe. This is also an alternative to rings 46 in FIG. 2.

Another alternate in FIG. 3 is the use of a circular cam arm or bar assembly 52 that pivots from the aforementioned point 36 (see also FIG. 2) and sequentially rides on four cam pins 53 located on drive gear or drive gear wheel 21*a* and activates man 30. This cam arm design does not move man 30 up and down as far as cam arm 35 in FIG. 2, but with 4 cam points rather than 3, it cycles more frequently, and the up and down moving motion of the circle of the cam arm or bar 52 adds to the optical illusory kinetic effect.

This cam arm 52 also activates man 27 through link 52*a* rather than the rotating pivot pin 34 in FIG. 2. This cycles the movements of main 27 in an up and down manner rather than rotatably and cycles such movement four times as often as the embodiment in FIG. 2.

I claim as my invention:

1. In a clock including minute and hour hands journalled for rotation in clockwise directions in vertical planes about a common axis, that is horizontally disposed and and extends normally of said vertical planes and of the action of gravity, and a timekeeping mechanism means for simultaneously driving said minute and hour hands at 1/60 rpm and 1/170 rpm, respectively, about said common axis, including a drive shaft therefor, means for rotating said drive shaft about its axis to drive same, and driving and driven gear wheel means intercoupled with said drive shaft and said minute and hour hands respectively for rotating same about their said common axis at their said respective speeds in said clockwise direction, the improvement comprising a kinetic sculpture arrangement therefor comprising:

a drive gear wheel having an axis of rotation paralleling that of said common axis and driven by the drive shaft and about said axis of said drive gear wheel, a driven gear wheel journalled for rotation about its axis and being coupled to said drive gear wheel for rotation thereby, said kinetic sculpture arrangement driven gear wheel rotationally driving a crank about a horizontal axis, to move up and down in one direction in a circular path that is vertically disposed, said drive gear wheel being relatively large and said driven gear wheel being relatively small, and a drive gear wheel actuated mechanical linkage of miniature stick figure form articulated to said crank whereby said crank and said linkage comprise a kinetic sculpture device, said linkage defining a stick figure comprising:

a stick figure body including a head at one end thereof, a shoulder cross pin carried by said body adjacent said head, and a hip cross pin paralleling said shoulder cross pin and carried by said body at the other end thereof, a pair of stick figure arms carried by said shoulder cross pin, one on either side of said body, and at like ends of said arms, and a pair of stick figure legs carried by said hip cross pin, one on either side of said body, and at like ends of said legs, with the said linkage being disposed in upright relation adjacent to and at the level of said crank and having the other ends of said stick figure legs thereof anchored below said crank and the other ends of said stick figure arms being articulated to said crank for following the rotation of same about said circular path, said crank having a throw leverage that is a fraction of the radius of said kinetic sculpture arrangement drive gear wheel but exceeds that of said kinetic sculpture arrangement driven gear wheel, and with said stick figure body, arms, and legs of said linkage being contoured, anchored and articulated in place for simulating front to back human like motion, in following the rotation of said crank about said circular path, suggestive of that said stick figure is assisting in driving said timekeeping mechanism means.

2. The improvement set forth in claim 1 wherein:

said stick figure is of human contour in configuration.

3. The improvement set forth in claim 20 wherein:

said drive gear wheel is directly driven by the drive shaft at a drive shaft speed on the order of four rpm.

4. The improvement set forth in claim 1 wherein:

said kinetic sculpture arrangement further includes:

a plurality of cam studs carried by said drive gear wheel on one side thereof in substantially parallel, equally spaced, relation about the circumference of said drive gear wheel, said cam studs paralleling said drive gear wheel axis and being in coplanar relation in a plane paralleling said drive gear wheel, and a cam arm disposed in said plane in overlying relation to said cam studs and having one end of same anchored for pivotal movement about an axis extending normally of said plane and spaced to one side of said drive gear wheel beyond said circumference thereof, said cam arm having the other end of same extending to the other side of said drive gear, said cam arm being supported against gravity by one or more of said cam studs and oscillated in said plane about said axis thereof by said drive gear wheel cam studs consecutively camming same as said drive gear wheel rotates, and at least one cam arm actuated mechanical linkage of miniature stick figure form articulated to said cam arm whereby said cam arm and said cam arm actuated linkage comprise a further kinetic sculpture device, said cam arm actuated linkage defining a cam arm actuated stick figure comprising:

a stick figure body including a head at one end thereof, a shoulder cross pin carried by said cam actuated linkage body adjacent said head thereof, and a hip cross pin paralleling said cam actuated stick figure shoulder cross pin and carried by said cam actuated linkage body at the other end thereof, a pair of stick figure arms carried by said cam actuated link body shoulder cross pin, one on either side of said body, and at like ends of said arms thereof, and a pair of stick figure legs carried by said cam arm actuated linkage body hip cross pin, one on either side of said body thereof, and at like ends of said legs thereof, with the said cam arm actuated linkage having the other ends of the stick figure legs thereof anchored below the heads thereof, and the other ends of the stick figure arms thereof being articulated to said cam arm for following said oscillations of same about said cam arm one end pivot axis, and with said stick figure body, arms and legs of said further kinetic sculpture device being contoured, anchored and articulated in place for simulating front to back human like motion, in following the oscillations of said cam arm, suggestive of that it is assisting in driving said timekeeping mechanism means.

5. The improvement set forth in claim 4 wherein:

said other ends of said legs of said cam arm actuated linkage are fixed against pivotal movement and are located adjacent said one side of said drive rear wheel at a level below the level of said drive gear wheel axis, said cam arm actuated linkage having said other ends of said arms thereof pivotally connected to a link that is fixed to and depends from said cam arm at a location spaced from said cam arm axis and proportioned lengthwise thereof to dispose said one cam arm actuated linkage in substantially upright relation for back and forth swinging movement of said body thereof about said hip cross pin thereof.

6. The improvement set forth in claim 4 wherein:
said other ends of said legs of said cam arm actuated linkage are mounted for pivotal movement about a stationary axis at a level about the level of said drive gear wheel axis at a location adjacent said plane and below said other end of said cam arm,
said cam arm actuated linkage having said other ends of said arms pivotally connected to said cam arm adjacent said other end of said cam arm in hanging relation thereto for up and down oscillation thereof in following said oscillation of said cam arm.

7. The improvement set forth in claim 6 wherein:
said cam arm is of zig-zag configuration in said plane.

8. The improvement set forth in claim 5 wherein:
said cam arm at said other end of same is of circular configuration in said plane.

9. The improvement set forth in claim 1 wherein:
said kinetic sculpture arrangement further includes:
a pair of rocking beams mounted about said drive gear wheel in spaced apart relation for swinging movement about a horizontal axis paralleling said driven gear wheel axis and disposed in a vertical plane that includes said drive gear wheel axis,
said rocking beam axis being intermediate the opposite ends of the respective rocking beams,
linkage means articulated between said crank and said beams for swinging the latter about said axis thereof on rotation of said drive gear wheel,
and a rocking beam actuated additional mechanical linkage of miniature stick figure form disposed adjacent said rocking beams and actuated by said swinging of said beams whereby said beams and said linkage comprise an additional kinetic sculpture device,
said rocking beam actuated additional linkage defining a rocking beam actuated stick figure comprising:
a stick figure body including a head at one end thereof, a shoulder cross pin carried by said rocking beam actuated linkage body adjacent said head thereof, and a hip cross pin paralleling said rocking beam actuated stick figure shoulder cross pin and carried by said rocking beam actuated linkage body at the other end thereof,
a pair of stick figure arms carried by said rocking beam actuated linkage body shoulder cross pin, one on either side of said body thereof, and at like ends of said arms thereof,
and a pair of stick figure legs carried by said rocking beam actuated linkage body hip cross pin, one on either side of said body thereof, and at like ends of said legs thereof,
with said rocking beam actuated additional linkage being disposed adjacent and below like ends of the respective beams, with the stick figure legs thereof anchored below same and the other end of at least one of the stick figure arms thereof being articulated to one of the respective beam like ends for following the oscillations of same,
and with said stick figure body, arms, and legs of said additional kinetic sculpture device being contoured, anchored, and articulated in place for simulating front to back human like motion, in following the oscillations of said one rocking beam, suggestive of that it is assisting in driving said timekeeping mechanism means.

10. The improvement set forth in claim 9 wherein:
the other of said stick figure arms of said rocking beam actuated additional linkage is articulated to the other of said beams,
said stick figure legs of said rocking beam actuated additional linkage being stationary relative to said body thereof, with said body thereof articulating at said hip pin thereof an oscillation of said rocking means,
said crank being formed to oppositely oscillate said beams through said linkage means on rotation of said drive gear wheel.

11. The improvement set forth in claim 9 wherein:
the other of the stick figure arms of said rocking beam actuated linkage is pivotally anchored at said other end thereof below said rocking beams and above the anchoring of the stick figure legs thereof,
said rocking beam actuated additional linkage being in hanging relation from the said rocking beam it is articulated with, and with said legs thereof being anchored to define a common pivot axis that substantially parallels said rocking beam axis.

12. The improvement set forth in claim 1 wherein:
said drive gear wheel is vertically disposed,
and including a further mechanical linkage of miniature stick figure form disposed in upright relation adjacent one side of said drive gear wheel,
said further linkage defining an additional stick figure comprising:
a stick figure body including a head at one end thereof, a shoulder cross pin carried by said further linkage body adjacent said head thereof, and a hip cross pin paralleling said additional stick figure shoulder cross pin and carried by said further linkage body at the other end thereof,
a pair of stick figure arms carried by said further linkage body shoulder cross pin, one on either side of said body thereof, and at like ends of said arms thereof,
and a pair of stick figure legs carried by said further linkage body hip cross pin, one on either side of said body thereof, and at like ends of said legs thereof,
with the said further linkage having the other ends of said stick figure arms thereof pivotally connected to said drive gear wheel at a common pivot axis that is radially spaced from said drive gear wheel axis for circular movement about said drive gear wheel axis as said drive gear wheel rotates,
and with said further linkage having the other ends of said stick figure legs thereof anchored stationarily below said head thereof for effecting back and forth motion of said body thereof in accommodating said circular movement of said other ends of said arms thereof at said common pivot axis, whereby said drive gear wheel and said further linkage comprising a further kinetic sculpture device,
and with said further linkage stick figure body, arms and legs being contoured, anchored and articulated in place for simulating front to back human like motion, in following said rotation of said drive gear wheel, suggestive of that said additional stick figure is assisting in driving said timekeeping mechanism means.

13. The improvement set forth in claim 1 including:
a further driven gear wheel journalled for rotation about its axis and coupled to said drive gear wheel for rotation thereby, said further driven gear being journalled for rotation about an upright axis, said further driven gear wheel being keyed to an upright shaft journalled for rotation about its longitudinal axis coincident said said further driven gear wheel upright axis and extending upwardly from said further driven gear wheel to dispose said upright shaft upper end above the level of the timekeeping mechanism means, and a ring structure fixed to said upper end of said upright shaft and centered with respect thereto for kinetic motion asthetics on rotation of said drive gear wheel.

14. The improvement set forth in claim 1 wherein:

said drive gear wheel is vertically disposed, a further driven gear wheel journalled for rotation about its axis and coupled to said drive gear wheel for rotation thereby, said further driven gear wheel being keyed to an upright shaft journalled for rotation about its longitudinal axis coincident with said further driven gear wheel upright axis and extending upwardly from said further driven gear wheel to dispose said upright shaft upper end above the level of the timekeeping mechanism means, and a bifurcated pendulum mounted above said drive gear wheel for pivotal free swinging movement about a horizontal axis paralleling said drive gear wheel axis, with said timekeeping mechanism means common axis, said drive gear wheel axis, and said pendulum pivotal axis being substantially aligned vertically, said pendulum straddling said timekeeping mechanism means common axis and defining a pair of depending arms disposed on either side of said timekeeping mechanism means common axis, and an upwardly projecting arm at the juncture of said depending arms that projects above said pendulum pivotal axis, said upright shaft being disposed in close adjacency to said vertically aligned axes, said upright shaft upper end projecting to the level of said pendulum upwardly projecting arm, said upright shaft upper end having fixed to same a cam pin extending laterally thereof at said level of said pendulum and proportioned lengthwise thereof to strike said pendulum projecting arm on rotation of said upright shaft for effecting swinging movement of said pendulum about its said axis.

15. In a clock including minute and hour hands journalled for rotation in clockwise directions in vertical planes about a common axis, that is horizontally disposed and extends normally of said vertical planes and of the action of gravity, and a timekeeping mechanism means for simultaneously driving said minute and hour hands at 1/60 rpm and 1/720 rpm, respectively, about said common axis, including a drive shaft therefor, means for rotating said drive shaft about its axis to drive same, and driving and driven gear wheel means intercoupled with said drive shaft and said minute and hour hands respectively for rotating same about their said common axis at their said respective speeds in said clockwise direction, the improvement comprising a kinetic sculpture arrangement therefor comprising:

a drive gear wheel having an axis of rotation paralleling that of said common axis and driven by the drive shaft and about said axis of said drive gear wheel, a plurality of driven gear wheels journalled for rotation about substantially horizontal axes and respectively coupled to said drive gear wheel for rotation thereby, each of said kinetic sculpture arrangement driven gear wheels rotationally driving a separate crank about a horizontal axis, to move up and down in one direction in a circular path that is vertically disposed, said drive gear wheel being relatively large and said driven gear wheels being relatively small and disposed in coupled relation to said drive gear wheel at spaced apart positions thereabout, said separate cranks each having articulated to same its own drive gear wheel actuated mechanical linkage of miniature stick figure form whereby each said crank and said linkage thereof comprise a kinetic sculpture device, said linkages each defining a stick figure comprising:

a stick figure body including a head at one end thereof, a shoulder cross pin carried by said body adjacent said head, and a hip cross pin paralleling said shoulder cross pin and carried by said body at the other end thereof, a pair of stick figure arms carried by said shoulder cross pin, one on either side of said body, and at like ends of said arms, and a pair of stick figure legs carried by said hip cross pin, one on either side of said body, and at like ends of said legs, said cranks each having a throw leverage that is a fraction of the radius of said drive gear wheel but exceeds that of the driven gear wheel driving same, said kinetic sculpture devices each further comprising:

said linkage thereof being disposed in upright relation adjacent to and at the level of the crank thereof, and having the other ends of said stick figure legs thereof anchored below said crank thereof, and the other ends of said stick figure arms being articulated to said crank thereof for following the rotating of same about said circular path thereof, and with said stick figure body, arms and legs of the respective kinetic sculpture devices being contoured, anchored and articulated in place for simulating front to back human like motion, in following the rotation of the said crank to which same is articulated, suggestive of that said stick figures are assisting in the driving said timekeeping mechanism means.

16. The improvement set forth in claim 15 wherein:

said other ends of said stick figure legs of one of said linkages are anchored for pivot action about a common axis, and the other ends of said stick figure legs of another of said linkages are anchored in forwardly and rearwardly spaced apart fixed relation for pivotal movement of said stick figure body thereof relative thereto under the driving action of said drive gear wheel.

17. The improvement set forth in claim 15 wherein:

one of said cranks has a fly wheel fixed thereto in substantial concentric relation with said one crank axis for rotation thereabout with said one crank.

18. In a clock including minute and hour hands journalled for rotation in clockwise directions in vertical planes about a common axis, that is horizontally disposed and extends normally of said vertical planes and of the action of gravity, and a timekeeping mechanism means for simultaneously driving said minute and hour hands at 1/60 rpm and 1/720 rpm, respectively, about said common axis, including a drive shaft therefor, means for rotating said drive shaft about its axis at a speed on the order of 4 rpm, and driving and driven gear wheel means intercoupled with said drive shaft and said minute and hour hands respectively for rotating same about their said common axis at their said respective speeds in said clockwise direction, the improvement comprising a kinetic sculpture arrangement thereof comprising:

a drive gear wheel driven by the drive shaft and about the axis of said drive gear wheel, said drive gear wheel being vertically disposed whereby said axis thereof is horizontally disposed, a plurality of cam studs carried by said drive gear wheel on one side thereof in substantially parallel, equally spaced, relation about the circumference of said drive gear, said cam studs paralleling said drive gear wheel axis and being in coplanar relation in a plane paralleling said drive gear wheel, and a cam arm disposed in said plane in overlying relation to said cam studs and having one end of same anchored for pivotal movement about an axis extending normally of said plane and spaced to one side of said drive gear wheel beyond said circumference thereof, said cam arm having the other end of same extending to the other side of said drive gear, said cam arm being supported against gravity by one or more of said cam studs and oscillated in said plane about said axis thereof by said drive gear wheel cam studs consecutively camming same as said drive gear wheel rotates, and at least one cam arm actuated mechanical linkage of miniature stick figure form articulated to said cam arm whereby said cam arm and said cam arm actuated linkage comprise a kinetic sculpture device, said cam arm actuated linkage defining a cam arm actuated stick figure comprising:

a stick figure body including a head at one end thereof, a shoulder cross pin carried by said cam actuated linkage body adjacent said head thereof, and a hip cross pin carried by said cam actuated linkage body at the other end thereof and paralleling said shoulder cross pin thereof, a pair of stick figure arms carried by said cam actuated linkage body shoulder cross pin, one on either side of said body, and at like ends of said arms thereof, and a pair of stick figure legs carried by said cam arm actuated linkage body hip cross pin, one on either side of said body thereof, and at like ends of said legs thereof, with the said cam arm actuated linkage having the other ends of the stick figure legs thereof anchored below the heads thereof, and the other ends of the stick figure arms thereof being articulated to said cam arm for following said oscillations of same about said cam arm one end pivot axis, and with said stick figure body, arms and legs of said kinetic sculpture device being contoured, anchored and articulated in place for simulating front to back human like motion, in following the oscillations of said cam arm, suggestive of that it is assisting in driving said timekeeping mechanism means.

19. In a clock including minute and hour hands journalled for rotation in clockwise directions in vertical planes about a common axis, that is horizontally disposed and extends normally of said vertical planes and of the action of gravity, and a timekeeping mechanism means for simultaneously driving said minute and hour hands at 1/60 rpm and 1/720 rpm, respectively, about said common axis, including a drive shaft therefor, means for rotating said drive shaft about its axis at a speed on the order of 4 rpm, and driving and driven gear wheel means intercoupled with said drive shaft and said minute and hour hands respectively for rotating same about their said common axis at their said respective speeds in said clockwise direction, the improvement comprising a kinetic sculpture arrangement therefor comprising:

a drive gear wheel driven by the drive shaft and about the axis of said drive gear wheel, a driven gear wheel journalled for rotation about a substantially horizontal axis, means for coupling said driven gear wheel to said drive gear wheel for rotation thereby, said kinetic sculpture arrangement driven gear wheel driving a crank about a horizontal axis, to move up and down in one direction in a circular path that is vertically diposed, a pair of rocking beams mounted above said drive gear wheel in spaced apart relation for swinging movement about a horizontal axis paralleling said driven gear wheel axis and disposed in a vertical plane that includes said drive gear wheel axis, said rocking beam axis being intermediate the opposite ends of the respective rocking beams, linkage means articulated between said crank and said beams for swinging the latter about said axis thereof on rotation of said drive gear wheel, and a rocking beam actuated mechanical linkage of miniature stick figure form disposed adjacent said rocking beams and actuated by said swinging of said beams whereby said beams and said linkage comprise a kinetic sculpture device, said rocking beam actuated linkage defining a rocking beam actuated stick figure comprising:

a stick figure body including a head at one end thereof, a shoulder cross pin carried by said rocking beam actuated linkage body adjacent said head thereof, and a hip cross pin carried by said rocking beam actuated linkage body at the other end thereof and paralleling said shoulder cross pin thereof, a pair of stick figure arms carried by said rocking beam actuated linkage body shoulder cross pin, one on either side of said body thereof, and at like ends of said arms thereof, with said rocking beam actuated linkage being disposed adjacent and below like ends of the respective beams, with the stick figure legs thereof anchored below same and the other end of at least one of the stick figure arms thereof being articulated to one of said like ends of the respective beams for following the oscillation of same, and with said stick figure body, arms, and legs of said kinetic sculpture device being contoured, anchored, and articulated in place for simulating front to back human like motion, in following the oscillations of said one rocking beam, suggestive of that it is assisting in driving said timekeeping mechanism means.

20. The improvement set forth in claim 19 wherein:

the other of said stick figure arms of said rocking beam actuated linkage is articulated to the other of said beams, said stick figure legs of said rocking beam actuated linkage being stationary relative to said body thereof, with said body thereof articulating at said hip pin thereof on oscillation of said rocking beams, said crank being formed to oppositely oscillate said beams through said linkage means on rotation of said drive gear wheel.

21. The improvement set forth in claim 19 wherein:

the other of the stick figure arms of said rocking beam actuated linkage is pivotally anchored at a stationary pivot at said other end thereof below said rocking beams and above the anchoring of the stick figure legs thereof, said rocking beam actuated linkage being in hanging relation from the said rocking beam it is articulated with, and with said legs thereof being anchored to define a common pivot axis that substantially parallels said rocking beam axis.

* * * * *